US006034368A

United States Patent [19]

Song et al.

[11] Patent Number: 6,034,368

[45] Date of Patent: Mar. 7, 2000

[54] AC CORONA CURRENT REGULATION

[75] Inventors: Jing qing Song, Webster; Kenneth W. Pietrowski; James L. Pratt, both of Penfield, all of N.Y.

[73] Assignee: Xerox Corporation, Stamford, Conn.

[21] Appl. No.: 09/110,422

[22] Filed: Jul. 6, 1998

[51] Int. Cl.[7] ..... H01T 19/04

[52] U.S. Cl. ..... 250/324; 250/325

[58] Field of Search ..... 250/324, 325, 250/326; 399/89

[56] References Cited

U.S. PATENT DOCUMENTS

| | | | |
|---|---|---|---|
| 3,699,388 | 10/1972 | Ukai | 250/324 |
| 3,908,164 | 9/1975 | Parker | 323/265 |
| 3,950,680 | 4/1976 | Michaels et al. | 250/324 |
| 4,234,249 | 11/1980 | Weikel, Jr. et al. | 355/3 CH |
| 4,831,332 | 5/1989 | Rudisill et al. | 324/455 |

*Primary Examiner*—Bruce C. Anderson
*Attorney, Agent, or Firm*—Lloyd F. Bean II

[57] ABSTRACT

In an electrostatographic imaging apparatus employing at least one charging device, in an electrostatic charge process involving the creation of latent electrostatic images, A method for controlling corona current generation by said at least one charging device is disclosed. The method comprising the steps of: generating an AC current and an AC voltage with a power supply; measuring the steady state negative half cycle of current, filtering capacitive current spikes from said negative half cycle current measurement and generating a corona current feedback signal in response to said filtering step; and dynamically adjusting the AC voltage in response to the corona current feedback signal so that the steady state negative half cycle of current measured in said measuring step remains constant.

3 Claims, 6 Drawing Sheets

AC CORONA CURRENT REGULATION

The present invention relates generally to a power supply primarily for use in reproduction systems of the xerographic, or dry copying, more particularly, concerns a power supply for supplying high voltage at low current levels to charging devices.

Generally, the process of electrostatographic copying is initiated by exposing a light image of an original document onto a substantially uniformly charged photoreceptive member. Exposing the charged photoreceptive member to a light image discharges a photoconductive surface thereon in areas corresponding to non-image areas in the original document while maintaining the charge in image areas, thereby creating an electrostatic latent image of the original document on the photoreceptive member. This latent image is subsequently developed into a visible image by depositing charged developing material onto the photoreceptive member such that the developing material is attracted to the charged image areas on the photoconductive surface. Thereafter, the developing material is transferred from the photoreceptive member to a copy sheet or to some other image support substrate to create an image which may be permanently affixed to the image support substrate, thereby providing an electrophotographic reproduction of the original document. In a final step in the process, the photoconductive surface of the photoreceptive member is cleaned to remove any residual developing material which may be remaining on the surface thereof in preparation for successive imaging cycles.

The electrostatographic copying process described hereinabove is well known and is commonly used for light lens copying of an original document. Analogous processes also exist in other electrostatographic printing applications such as, for example, digital laser printing where a latent image is formed on the photoconductive surface via a modulated laser beam, or ionographic printing and reproduction where charge is deposited on a charge retentive surface in response to electronically generated or stored images.

As discussed above, in electrostatographic reproductive devices it is necessary to charge a suitable photoconductive or reproductive surface with a charging potential prior to the formation thereon of the light image. Various devices have been proposed for the application of the electrostatic charge or charge potential to the photoconductive insulating body of Carlson's invention; one method of operation employs, for charging the photoconductive insulating layer, a form of corona discharge wherein an adjacent electrode comprising one or more fine conductive bodies maintained at a high electric potential causes deposition of an electric charge on the adjacent surface of the photoconductive body. Examples of such corona discharge devices are described in U.S. Pat. No. 2,836,725, to R. G. Vyverberg and U.S. Pat. No. 2,922,883, to E. C. Giamio, Jr. In practice, one corotron (corona discharge device) may be used to charge the photoconductor before exposure and another corotron used to charge the copy sheet during the toner transfer step. Corotrons are cheap, stable units, but they are sensitive to changes in humidity and the dielectric thickness of the insulator being charged. Thus, the surface charge density produced by these devices may not always be constant or uniform.

This problem is more acute wherein the electrophotographic marking process given above is modified to produce color images. One color electrophotographic marking process, called image on image processing, superimposes toner powder images of different color toners onto the photoreceptor prior to the transfer of the composite toner powder image onto the substrate. While image on image process has several benefits, it has several problems. For example, when recharging the photoreceptor in preparation for creating another color toner powder image it is important to level the voltages uniformly between the previously toned and the untoned areas of the photoreceptor in a manner that minimizes toner charge throughout the layer without reversing its' polarity;

The currents generated by corotrons in electrostatographic systems have been regulated by various feedback techniques. Typically, the shield current, the plate current, or a grid current in the case of a scorotron, is detected and used to develop an error signal. The error signal is fed back to the power supply to increase or decrease the input voltage or current to compensate for the detected error. The reason for the regulation is to correct for changes in the ambient conditions of temperature and humidity, for coronode wire to plate spacing and for changes in capacitance such as that due to transfer paper thickness variations or photoconductor, i.e., the plate, thicknesses variations. In other words, the regulation of corotron current is to compensate for current fluctuations under changing load conditions.

For example, U.S. Pat. No. 4,234,249, an electrophotographic copying system is disclosed that employs a mixture of AC and DC corotrons energized by a common power supply. The DC corotrons are energized with an unfiltered, rectified AC voltage derived from the same source as the AC voltage applied to the AC corotrons so that all the corotrons are driven by voltages having a common wave shape. One of the corotrons is regulated by a feedback circuit coupled between the regulated or master corotron and the power supply. The other corotrons track the regulation of the master corotron.

SUMMARY OF THE INVENTION

Briefly, the present invention obviates the problems noted above by utilizing a method that allows us to control corona current generation by measuring and controlling the steady state negative half cycle of current. The amplitude of AC voltage will change as required to maintain a selected current value. By dynamically adjusting the AC voltage in response to the corona current feedback signal, many mechanical and environmental deviations can be compensated. This technique makes it much easier to achieve critical parameter tolerance targets as well as alleviate the need for special algorithms, look up tables or separate supplies to deal with the effects of barometric pressure on corona current generation in a constant AC voltage system.

Inasmuch as the art of electrophotographic printing is well known, the various processing stations employed in the printing machine will be shown hereinafter schematically and their operation described briefly with reference thereto.

DETAILED DESCRIPTION OF THE PRESENT INVENTION

Figure 1:
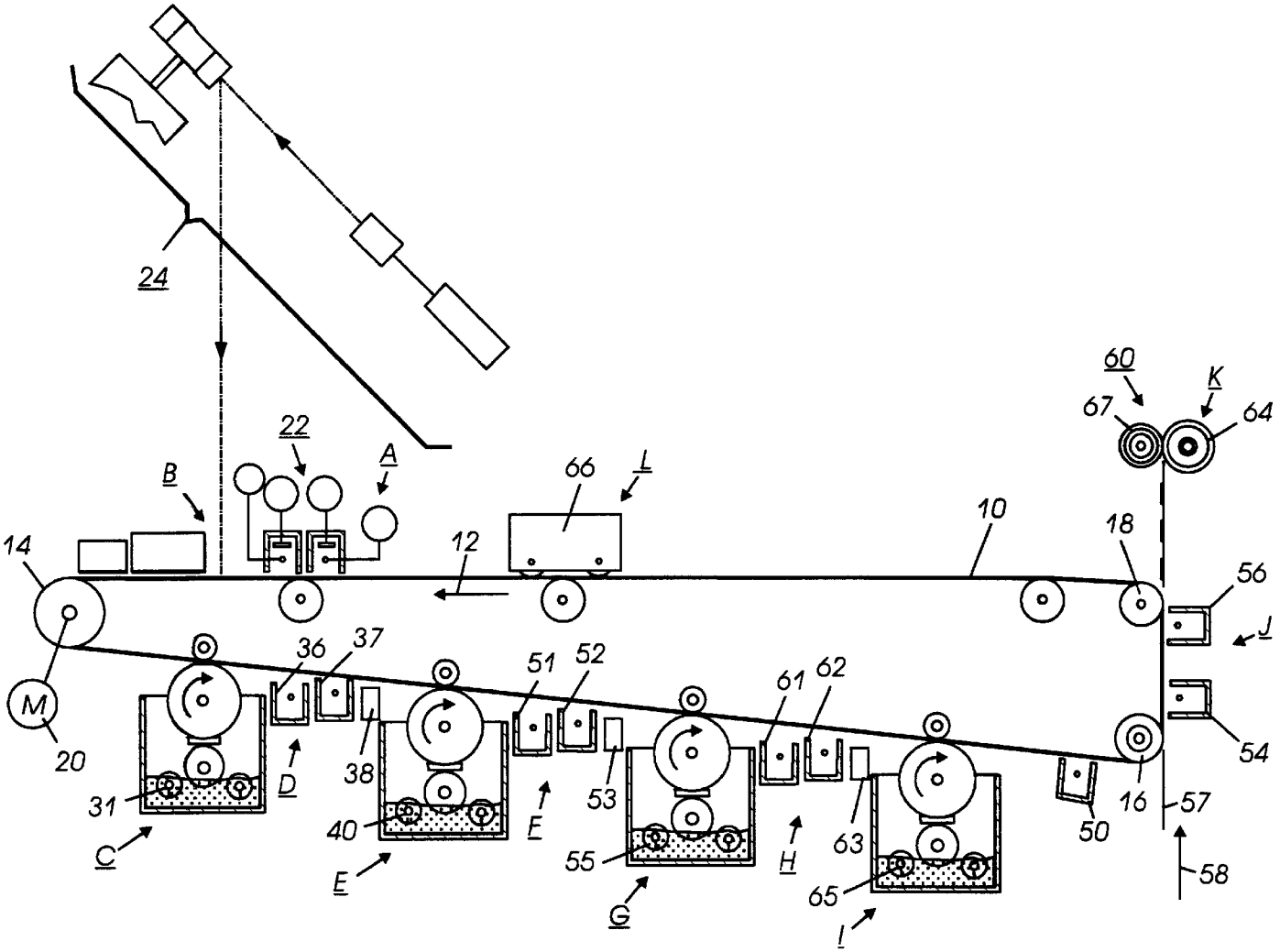
FIG. 1 is a schematic elevational view of an illustrative electrophotographic printing or imaging machine or apparatus incorporating a development apparatus having the features of the present invention therein.

Referring initially to FIG. 1, there is shown an illustrative electrophotographic machine having incorporated therein the development apparatus of the present invention. An electrophotographic printing machine 8 creates a color image in a single pass through the machine and incorporates the features of the present invention. The printing machine 8 uses a charge retentive surface in the form of an Active Matrix (AMAT) photoreceptor belt 10 which travels sequentially through various process stations in the direction indicated by the arrow 12. Belt travel is brought about by mounting the belt about a drive roller 14 and two tension rollers 16 and 18 and then rotating the drive roller 14 via a drive motor 20.

As the photoreceptor belt moves, each part of it passes through each of the subsequently described process stations. For convenience, a single section of the photoreceptor belt, referred to as the image area, is identified. The image area is that part of the photoreceptor belt which is to receive the toner powder images which, after being transferred to a substrate, produce the final image. While the photoreceptor belt may have numerous image areas, since each image area is processed in the same way, a description of the typical processing of one image area suffices to fully explain the operation of the printing machine.

Figure 2:
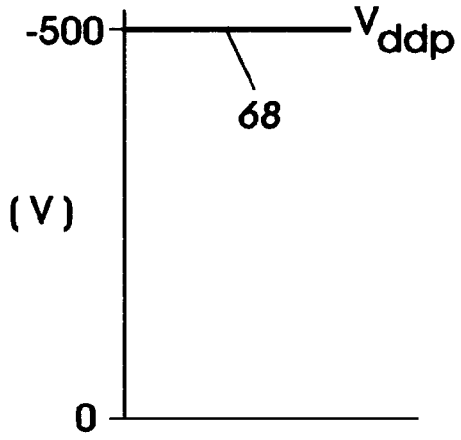
FIG. 2 shows a typical voltage profile of an image area in the electrophotographic printing machines illustrated in FIG. 1 after that image area has been charged.

As the photoreceptor belt 10 moves, the image area passes through a charging station A. At charging station A, a corona generating device preferably a bipolar AC wire scorotron is employed, indicated generally by the reference numeral 22, charges the image area to a relatively high and substantially uniform potential. FIG. 2 illustrates a typical voltage profile 68 of an image area after that image area has left the charging station A. As shown, the image area has a uniform potential of about −500 volts. In practice, this is accomplished by charging the image area slightly more negative than −500 volts so that any resulting dark decay reduces the voltage to the desired −500 volts. While FIG. 2 shows the image area as being negatively charged, it could be positively charged if the charge levels and polarities of the toners, recharging devices, photoreceptor, and other relevant regions or devices are appropriately changed.

Figure 3:
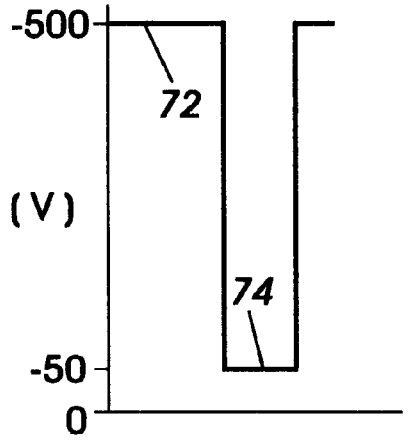
FIG. 3 shows a typical voltage profile of the image area after being exposed.

After passing through the charging station A, the now charged image area passes through a first exposure station B. At exposure station B, the charged image area is exposed to light which illuminates the image area with a light representation of a first color (say black) image. That light representation discharges some parts of the image area so as to create an electrostatic latent image. While the illustrated embodiment uses a laser based output scanning device 24 as a light source, it is to be understood that other light sources, for example an LED printbar, can also be used with the principles of the present invention. FIG. 3 shows typical voltage levels, the levels 72 and 74, which might exist on the image area after exposure. The voltage level 72, about −500 volts, exists on those parts of the image area which were not illuminated, while the voltage level 74, about −50 volts, exists on those parts which were illuminated. Thus after exposure, the image area has a voltage profile comprised of relative high and low voltages.

After passing through the first exposure station B, the now exposed image area passes through a first development station C which is identical in structure with development system E, G, and I. The first development station C deposits a first color, say black, of negatively charged toner 31 onto the image area. That toner is attracted to the less negative sections of the image area and repelled by the more negative sections. The result is a first toner powder image on the image area.

Figure 8:
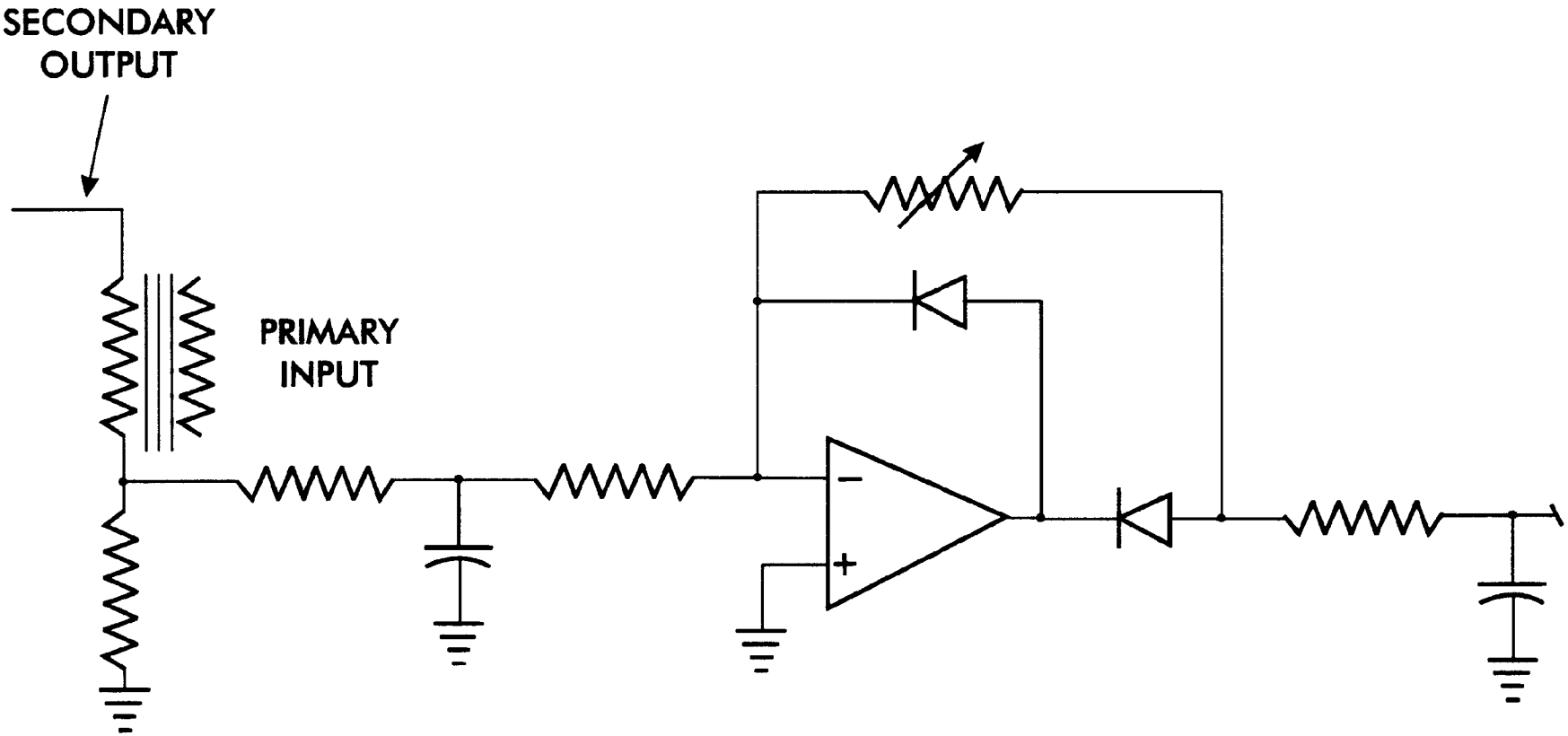
FIG. 8 is a schematic circuit diagram of the high voltage power supply in FIG. 1.

For the first development station C, development system 34 includes a donor roll 42. As illustrated in FIG. 8, electrode grid 90 is electrically biased with an AC voltage relative to doner roll 42 for the purpose of detaching toner therefrom so as to form a toner powder cloud 112 in the gap between the donor roll and photoconductive surface. Both electrode grid 90 and doner roll are biased at a DC potential 108 for discharge area development (DAD). The discharged photoreceptor image attracts toner particles from the toner powder cloud to form a toner powder image thereon.

Figure 4:
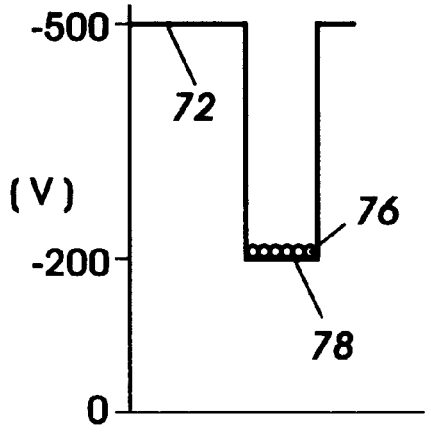
FIG. 4 shows a typical voltage profile of the image area after being developed.

FIG. 4 shows the voltages on the image area after the image area passes through the first development station C. Toner 76 (which generally represents any color of toner) adheres to the illuminated image area. This causes the voltage in the illuminated area to increase to, for example, about −200 volts, as represented by the solid line 78. The unilluminated parts of the image area remain at about the level −500 72.

After passing through the first development station C, the now exposed and toned image area passes to a first recharging station D. The recharging station D is comprised of two corona recharging devices, a first recharging device 36 and a second recharging device 37, which act together to recharge the voltage levels of both the toned and untoned parts of the image area to a substantially uniform level. It is to be understood that power supplies are coupled to the first and second recharging devices 36 and 37, and to any grid or other voltage control surface associated therewith, as required so that the necessary electrical inputs are available for the recharging devices to accomplish their task.

Figure 5:
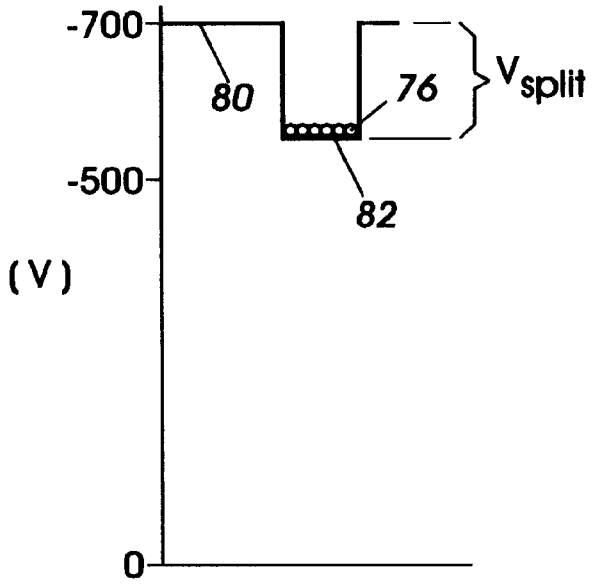
FIG. 5 shows a typical voltage profile of the image area after being recharged by a first recharging device.

FIG. 5 shows the voltages on the image area after it passes through the first recharging device 36. The first recharging device overcharges the image area to more negative levels than that which the image area is to have when it leaves the recharging station D. For example, as shown in FIG. 5 the toned and the untoned parts of the image area, reach a voltage level 80 of about −700 volts. The first recharging device 36 is preferably a DC scorotron.

Figure 6:
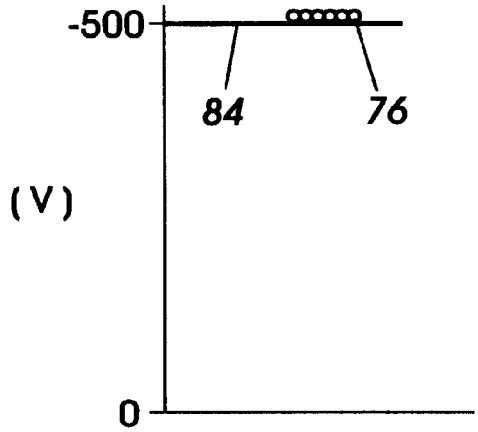
FIG. 6 shows a typical voltage profile of the image area after being recharged by a second recharging device.

After being recharged by the first recharging device 36, the image area passes to the second recharging device 37. Referring now to FIG. 6, the second recharging device 37 reduces the voltage of the image area, both the untoned parts and the toned parts (represented by toner 76) to a level 84 which is the desired potential of −500 volts.

Figure 7:
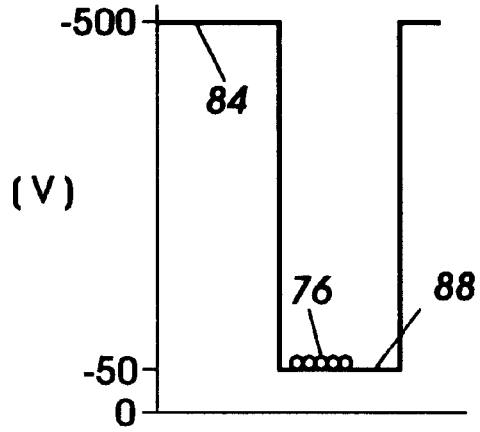
FIG. 7 shows a typical voltage profile of the image area after being exposed for a second time.

After being recharged at the first recharging station D, the now substantially uniformly charged image area with its first toner powder image passes to a second exposure station 38. Except for the fact that the second exposure station illuminates the image area with a light representation of a second color image (say yellow) to create a second electrostatic latent image, the second exposure station 38 is the same as the first exposure station B. FIG. 7 illustrates the potentials on the image area after it passes through the second exposure station. As shown, the non-illuminated areas have a potential about −500 as denoted by the level 84. However, illuminated areas, both the previously toned areas denoted by the toner 76 and the untoned areas are discharged to about −50 volts as denoted by the level 88.

The image area then passes to a second development station E. Except for the fact that the second development station E contains a toner 40 which is of a different color (yellow) than the toner 31 (black) in the first development station C, the second development station is substantially the same as the first development station. Since the toner 40 is attracted to the less negative parts of the image area and repelled by the more negative parts, after passing through the second development station E the image area has first and second toner powder images which may overlap.

The image area then passes to a second recharging station F. The second recharging station F has first and second recharging devices, the devices 51 and 52, respectively, which operate similar to the recharging devices 36 and 37. Briefly, the first corona recharge device 51 overcharges the image areas to a greater absolute potential than that ultimately desired (say −700 volts) and the second corona recharging device, comprised of coronodes having AC potentials, neutralizes that potential to that ultimately desired.

The now recharged image area then passes through a third exposure station 53. Except for the fact that the third exposure station illuminates the image area with a light representation of a third color image (say magenta) so as to create a third electrostatic latent image, the third exposure station 38 is the same as the first and second exposure stations B and 38. The third electrostatic latent image is then developed using a third color of toner 55 (magenta) contained in a third development station G.

The now recharged image area then passes through a third recharging station H. The third recharging station includes a pair of corona recharge devices 61 and 62 which adjust the voltage level of both the toned and untoned parts of the image area to a substantially uniform level in a manner similar to the corona recharging devices 36 and 37 and recharging devices 51 and 52.

After passing through the third recharging station the now recharged image area then passes through a fourth exposure station 63. Except for the fact that the fourth exposure station illuminates the image area with a light representation of a fourth color image (say cyan) so as to create a fourth electrostatic latent image, the fourth exposure station 63 is the same as the first, second, and third exposure stations, the exposure stations B, 38, and 53, respectively. The fourth electrostatic latent image is then developed using a fourth color toner 65 (cyan) contained in a fourth development station I.

To condition the toner for effective transfer to a substrate, the image area then passes to a pretransfer corotron member 50 which delivers corona charge to ensure that the toner particles are of the required charge level so as to ensure proper subsequent transfer.

After passing the corotron member 50, the four toner powder images are transferred from the image area onto a support sheet 57 at transfer station J. It is to be understood that the support sheet is advanced to the transfer station in the direction 58 by a conventional sheet feeding apparatus which is not shown. The transfer station J includes a transfer corona device 54 which sprays positive ions onto the backside of sheet 57. This causes the negatively charged toner powder images to move onto the support sheet 57. The transfer station J also includes a detack corona device 56 which facilitates the removal of the support sheet 52 from the printing machine 8.

After transfer, the support sheet 57 moves onto a conveyor (not shown) which advances that sheet to a fusing station K. The fusing station K includes a fuser assembly, indicated generally by the reference numeral 60, which permanently affixes the transferred powder image to the support sheet 57. Preferably, the fuser assembly 60 includes a heated fuser roller 67 and a backup or pressure roller 64. When the support sheet 57 passes between the fuser roller 67 and the backup roller 64 the toner powder is permanently affixed to the sheet support 57. After fusing, a chute, not shown, guides the support sheets 57 to a catch tray, also not shown, for removal by an operator.

After the support sheet 57 has separated from the photoreceptor belt 10, residual toner particles on the image area are removed at cleaning station L via a 4 cleaning brush contained in a housing 66. The image area is then ready to begin a new marking cycle.

The various machine functions described above are generally managed and regulated by a controller which provides electrical command signals for controlling the operations described above.

Referring now to FIG. 8 in greater detail, in the present invention, commands from the system controller setup the output voltage levels of the power supply. These output levels of the power supply then provide though the secondary winding of the output transformer a total current which is measured across a low impedance element (resistor). The current is then filtered to remove the capacitive spike and then rectified to allow half cycle monitoring. (NOTE: Both polarities (positive or negative) work, with the preference being negative.) This information is then feedback to the system to make output level adjustments.

Having in the mind a understanding of the structure of the present invention, the operation thereof can be had from the following description.

Figure 9:
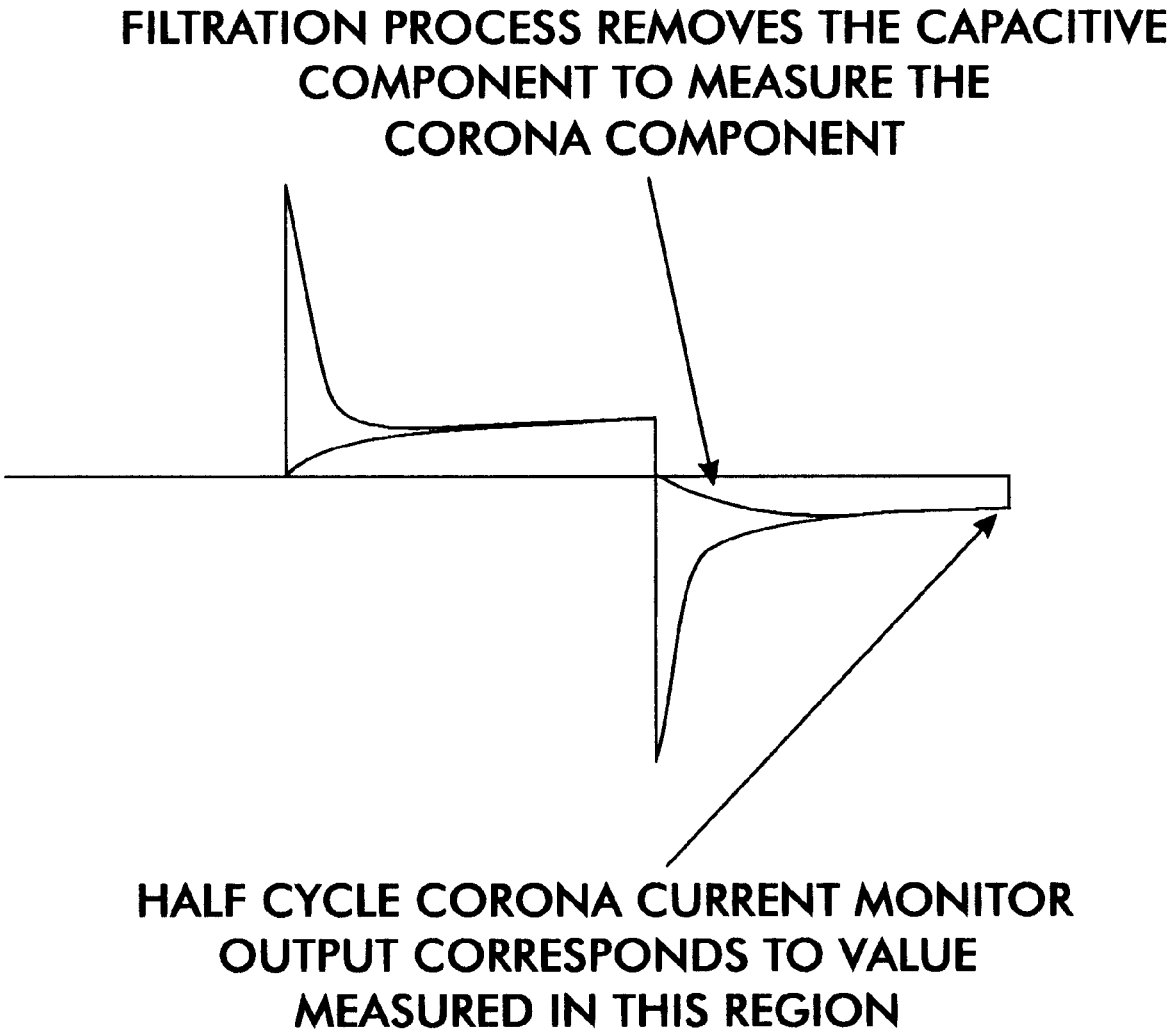
FIG. 9 is a graph of the current versus voltage (IV) curve used with the present invention.

For example, an I-V characteristic slope of 1.5±0.4 microamps/meter-volt is preferred at a process speed of 12 inches/sec is desired to be maintained. A key parameter controlling slope and intercept voltage is the corona current. We currently attempt to maintain the corona current constant by fixing the amplitude of the AC operating voltage and its DC offset. There are many electrical/mechanical critical parameters and their tolerances that can cause the current to deviate at a constant voltage operating mode including the accuracy of the voltage setting, its regulation, waveform rise time and other mechanical spacings and their tolerances. When considering all the manufacturable tolerances our analysis it has been found that the expected I-V slope variation will be in the 0.5 to 2.9 microamps/meter-volt range. Tightening up the range would require extremely tight tolerances hence prohibitively higher costs. The preferred solution path is to devise a way to measure and control the corona current directly independent of some mechanical variations and environmental swings (especially barometric pressure) that would cause the current to vary with a fixed applied voltage. In this scheme the AC voltage amplitude would vary to maintain the prescribed current constant hence I-V slope. In the present invention the slope of the I-V characteristic within the process latitude window is controlled by measuring and controlling the steady state peak value of the negative half current cycle. This is illustrated in FIG. 9. The initial current spike at the beginning of the positive and negative voltage swings is associated with the capacitive current that is of no value to corona generation. The steady state value after the initial spike corresponds to the corona current of interest. By using a filter, the capacitive current spike is removed. The value of peak steady state current that is measured and controlled is as shown. It has been found that the value of current measured in this manner is linearly proportional to the total average negative corona current and that it can be accurately controlled by varying the amplitude of the AC voltage with a fixed DC offset.

Figure 10:
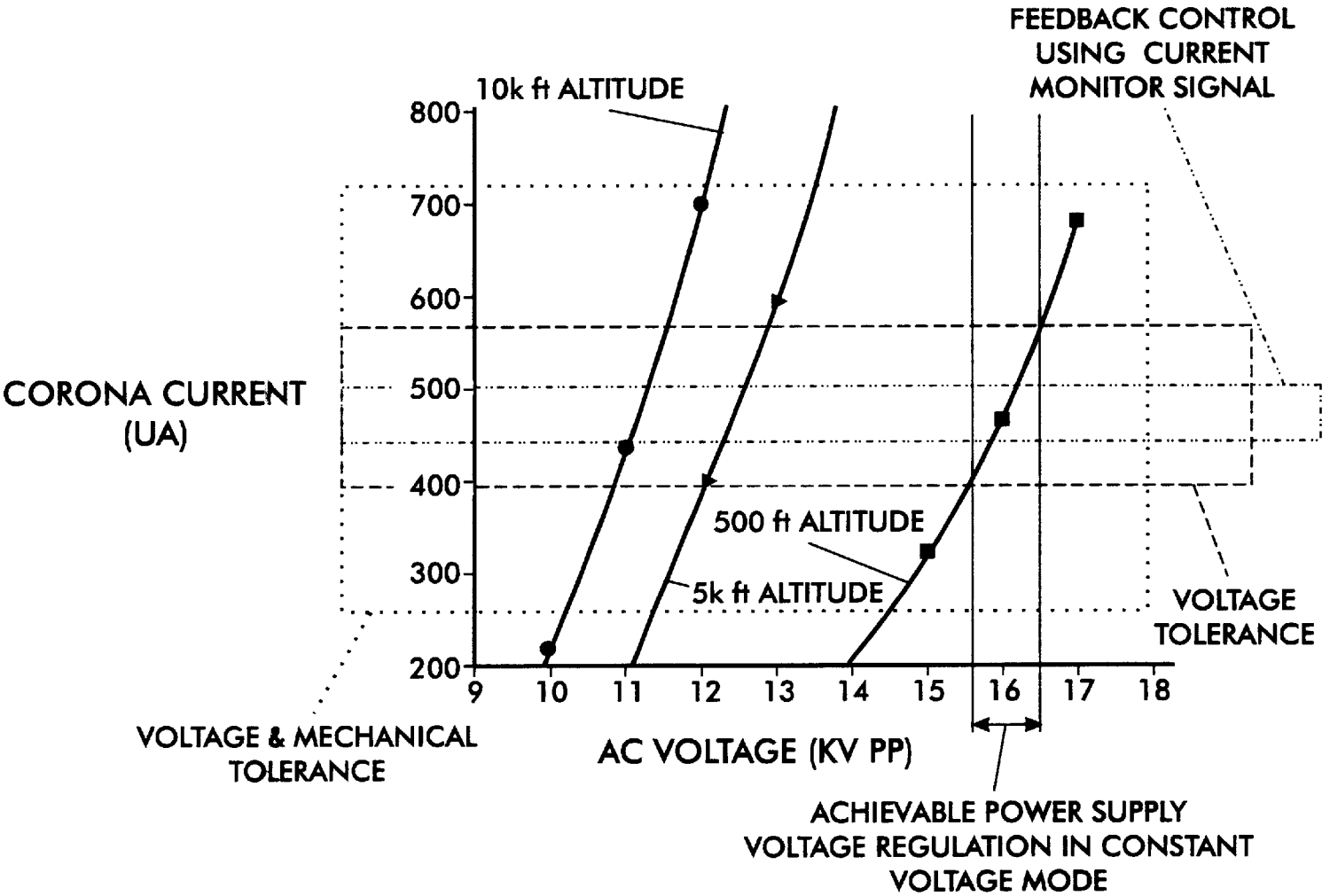
FIG. 10 is a graph of a corona current versus an AC voltage.

Using this strategy, we are able to maintain the I-V characteristic slop in the 1.4 to 1.6 range at mechanical tolerance extremes. This contrasts the unacceptable 0.5 to 2.9 range quoted earlier for the same tolerance extremes and constant AC voltage amplitude with its achievable regulation and target setting accuracy. This scheme also compensates for the variations that would occur due to environmental changes (mainly barometric pressure). Large changes in corona current generation accompany changes in barometric pressure at fixed wire voltages. This closed loop scheme eliminates the need for an additional open loop strategy to deal with machine location at different altitudes. The latter would require an altitude dependent voltage setpoint strategy adding cost and complexity. Test data shows in FIG. 10 that we are able to maintain the I-V characteristic slope in the acceptable 1.2 to 1.8 as the altitude changes from 0 ft. to 10K ft.

Other embodiments and modifications of the present invention may occur to those skilled in the art subsequent to a review of the information presented herein; these embodiments and modifications, as well as equivalents thereof, are also included within the scope of this invention.

We claim:

1. In an electrostatographic imaging apparatus employing at least one charging device, in an electrostatic charge process involving the creation of latent electrostatic images, A method for controlling corona current generation by said at least one charging device, the method comprising the steps of:

generating an AC current and an AC voltage with a power supply;

measuring the steady state half cycle of current, filtering capacitive current spikes from said half cycle current measurement and generating a corona current feedback signal in response to said filtering step; and dynamically adjusting the AC voltage in response to the corona current feedback signal so that the steady state half cycle of current measured in said measuring step remains constant.

2. The method according to claim 1, wherein said negative half cycle of current is employed.

3. The method according to claim 1, wherein said dynamically adjusting means maintains a current versus voltage (I-V) characteristic slope between 1.2 to 1.8 as the altitude changes from 0 ft. to 10K ft.

* * * * *